United States Patent [19]

Sharp et al.

[11] 4,309,786

[45] Jan. 12, 1982

[54] BUOY FLOTATION SYSTEM

[75] Inventors: David A. Sharp, Newport, R.I.; David J. Salisbury, Fort Wayne, Ind.

[73] Assignee: Raytheon Company, Lexington, Mass.

[21] Appl. No.: 84,250

[22] Filed: Oct. 12, 1979

[51] Int. Cl.[3] ..... B63B 51/02

[52] U.S. Cl. ..... 9/8 R

[58] Field of Search ..... 9/8 R, 9, 314, 315, 9/316, 318, 319, 320, 324; 141/19; 137/67 F, 68 R, 68 A; 222/5, 80, 81, 82, 83, 83.5, 87, 89; 89/1 B

[56] References Cited

U.S. PATENT DOCUMENTS

| | | | |
|---|---|---|---|
| 2,801,026 | 7/1957 | Fruendt | 9/319 |
| 3,320,669 | 5/1967 | Chandler | 89/1 B |
| 3,780,689 | 12/1973 | Giebel | 89/1 B |
| 3,983,892 | 10/1976 | Hardesty | 137/68 A |

FOREIGN PATENT DOCUMENTS

| | | | |
|---|---|---|---|
| 6550 | of 1894 | United Kingdom | 9/318 |

*Primary Examiner*—Trygve M. Blix
*Assistant Examiner*—Jesús D. Sotelo
*Attorney, Agent, or Firm*—Martin M. Santa; Joseph D. Pannone

[57] ABSTRACT

A buoy flotation system, wherein a container of a compressed fluid is utilized for expansion of a float, includes a cutter for severing and removal of a portion of the container for releasing the compressed fluid. The cutter includes a piston having a recess in a side wall thereof for mating with the container, the piston being contained within a housing, the piston and the housing having cutting edges. An explosive charge drives the piston transversely of the container whereupon the cutting edges sever and remove a portion of the container for evacuation of the compressed fluid therefrom.

7 Claims, 8 Drawing Figures

BUOY FLOTATION SYSTEM

BACKGROUND OF THE INVENTION

This invention relates to a flotation system for a buoy and, more particularly, to the releasing of a compressed fluid from a container of such fluid for deployment of a float.

Buoys are frequently deployed on the surface of a body of water, such as the ocean, for identifying locations thereon and, in the case of sonobuoys, for receiving sonic signals which may be generated within the water. For example, sonobuoys may be dropped from aircraft, the sonbuoys containing flotation which is activated upon contact of the sonobuoy with the water for deployment of a float from which the sonobuoy is suspended at a predetermined distance below the surface of the water.

A flotation system which is in common use employs a container of a compressed fluid, such as carbon dioxide gas, in combination with a squib-firing circuit which employs an explosive charge for puncturing the container to release the compressed fluid. A battery, responsive to the salt water of the ocean, provides an electric current for activating the squib when the sonobuoy contacts the surface of the ocean.

A problem has arisen in the aforementioned puncturing of the container in that the resulting punctured region of the container provides a relatively small cross-section through which the escaping fluid must pass enroute to the float. As a result, the compressed fluid, which may comprise both liquid and gaseous carbon dioxide within the container, is cooled by the gas escaping through the constriction of the orifice at the point of puncture. Since a cooling of a fluid reduces the vapor pressure thereof, the rate of delivery of the gas to the float steadily diminishes with the result that the float may not have as much buoyancy as would be desired during the initial stages of the deployment of the float. As a result, reliable flotation may require an unduly large container of compressed fluid such that a sufficient amount of gas is released to the float before extensive cooling occurs to the fluid within the container. In many situations for the deployment of buoys, the physical size of the buoy is limited to a predetermined size so that the use of an unduly large container undesirably reduces the space available for other equipment within the buoy such as a sonar receiver and/or sonar transmitter.

SUMMARY OF THE INVENTION

The aforementioned problem is overcome and other advantages are provided by a buoy flotation system employing a container of a compressed fluid for the deployment of a float and wherein, in accordance with the invention, a portion of the container is severed therefrom to provide an essentially unrestricted passage of compressed gas from the container to the float. The container is preferably a metallic bottle, the neck of the bottle being the portion which is to be severed.

The invention provides for a cutter which is shaped to mate with the neck of the bottle to completely sever the neck from the bottle. Thereupon, the gas compressed within the bottle, as well as the gas from liquid boiling within the bottle, can exit rapidly from the resulting opening with essentially no restriction to the passage of the gas. Thereby, deployment of the float can occur rapidly without the aforementioned reduction in the rate of flow due to the aforementioned cooling associated with the restricted passage of fluid flow.

In a preferred embodiment of the invention, a housing having a cylindrical form connects the bottle with the float. A piston is positioned within a chamber of the housing for slidable movement along the axis of the chamber. The housing is provided with an aperture communicating with a recess in the side wall of the piston, the cross-sectional dimensions of the aperture and the recess being substantially equal to that of the neck of the bottle to permit the neck to extend through the aperture of the housing for mating with the recess in the piston. Both the aperture and the edge of the recess are provided with cutting edges whereby, upon a displacement of the piston relative to the bottle, the cutting edges provide a shearing of the neck from the remainder of the bottle. Upon completion of the displacement of the piston relative to the bottle, a valve body formed within the piston is brought into alignment with an opening in the bottle formed by the shearing of the neck. The valve communicates with ports in the housing whereby the gases within the bottle are conducted from the opening in the bottle to the ports and, by the ports, to the float. A squib is located within the housing posteriorly to the piston for generating an explosion which explosively drives the piston along the axis of the chamber. A salt-water battery which is positioned within the buoy for contacting the sea water, upon development of the buoy, provides electric power which activates the squib when the buoy comes in contact with the surface of the water.

BRIEF DESCRIPTION OF THE DRAWINGS

The aforementioned aspects and other features of the invention are explained in the following description taken in connection with the accompanying drawings wherein.

DESCRIPTION OF THE PREFERRED EMBODIMENT

Figure 1:
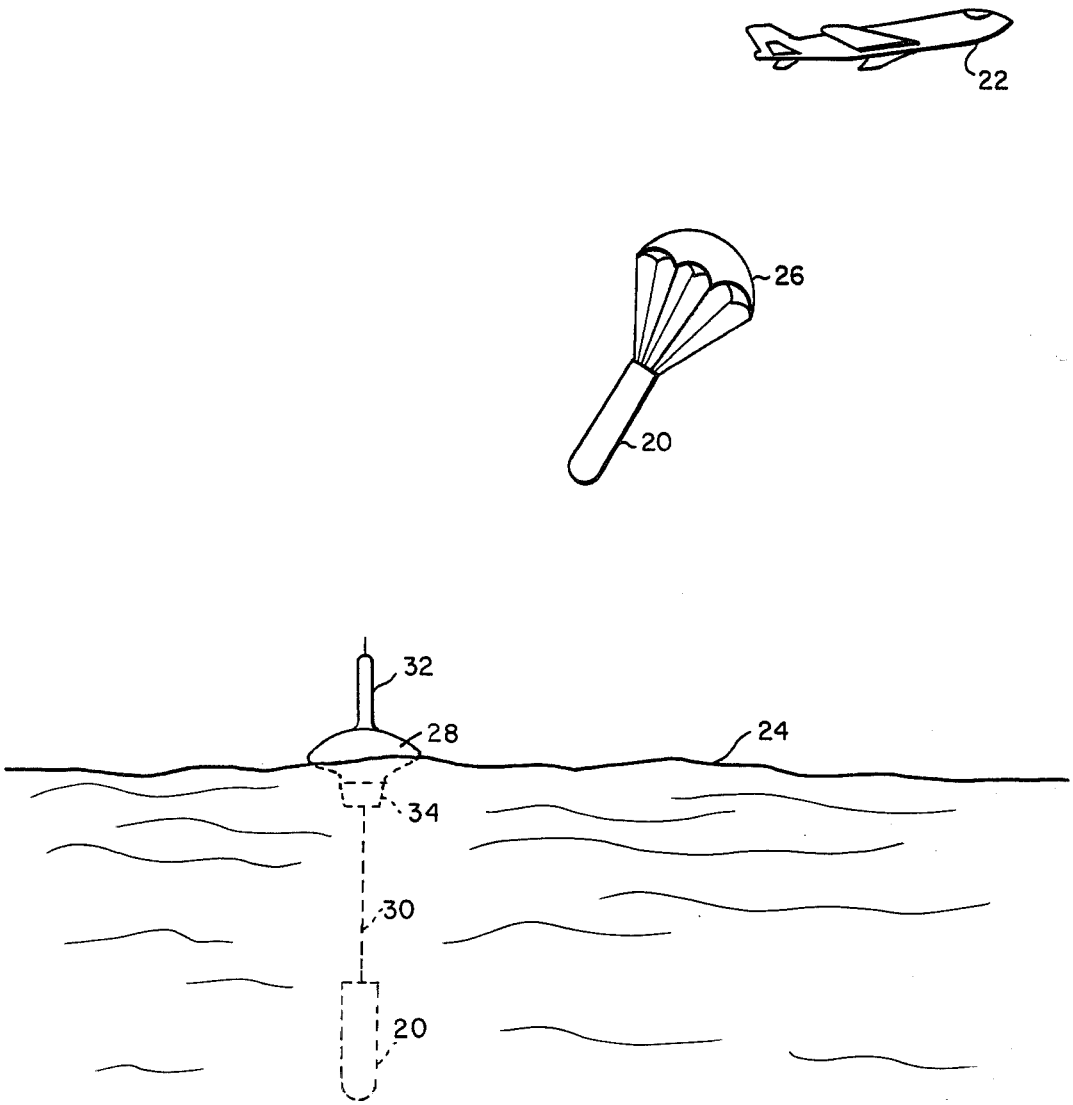
FIG. 1 shows a stylized pictorial view of sonobuoy being dropped from an aircraft into the ocean.

Referring now to FIG. 1, sonobuoys 20 are shown being dropped by an aircraft 22 into the ocean 24. The sonobuoys 20 are seen to include a parachute 26 which controls the rate of descent of the sonobuoy 20, and a float 28 which is deployed upon entry of the sonobuoy 20 into the ocean 24. One of the sonobuoys is shown submerged beneath the surface of the ocean 24 and suspended by a cable 30 at a predetermined depth below the surface of the ocean 24. The float 28 supports an antenna 32 by which electrical signals are communicated between the sonobuoy 20 and the aircraft 22.

Figure 2:
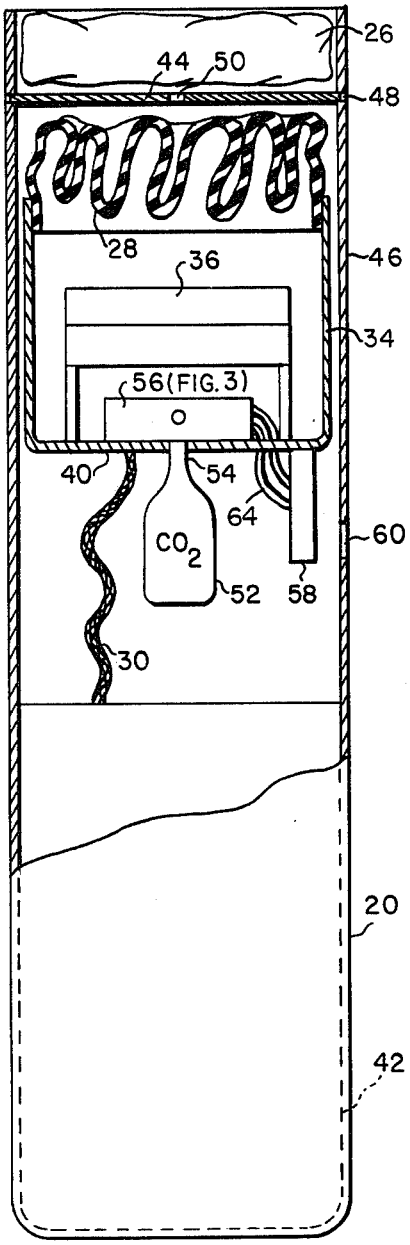
FIG. 2 shows an elevation view of a sonobuoy incorporating the cutter assembly of the invention, the sonobuoy being portrayed partly in section to show the cutter assembly.

Referring also to FIG. 2, the parachute 26 and the float 28 are seen to be folded and stowed within the upper end of the sonobuoy 20, prior to being dropped from the aircraft 22 of FIG. 1. The sonobuoy 20 includes a surface unit 34 which is withdrawn from the upper end of the sonobuoy 20 by the float 28 as the remaining portion of the sonobuoy 20 sinks to its predetermined depth. The surface unit 34 includes electronic circuitry 36 shown mounted on posts 38 to the floor 40 of the surface unit 34, the circuitry 36 including well known transmission and receiving circuits for transmitting signals between a sonar 42 in the bottom portion of the sonobuoy 20 and the aircraft 22. The rim of the surface unit 34 connects with the material of the float with an air-tight seal whereby, upon the application of a gas such as carbon dioxide to the interior of the surface unit 34, the float 28 is inflated. A plate 44 is secured to the housing 46 of the sonobuoy 20 by tabs 48 to hold the float within the housing 46 until the sonobuoy 20 reaches the ocean 24. The plate 44 is provided with a weakened region along its central line by means of a slot 50, extending part way across the plate 44, to permit a bending of the plate 44 in response to inflation pressures within the float 28. Thereby, upon inflation of the float 28, the plate 44 bends to withdraw the tabs 48 from the housing 46 for releasing the plate 44 and the float 28 from the sonobuoy 20. Compressed carbon dioxide fluid is contained within a bottle 52 having a neck 54 which extends through the floor 40 for inflation of the float 28.

Figure 3:
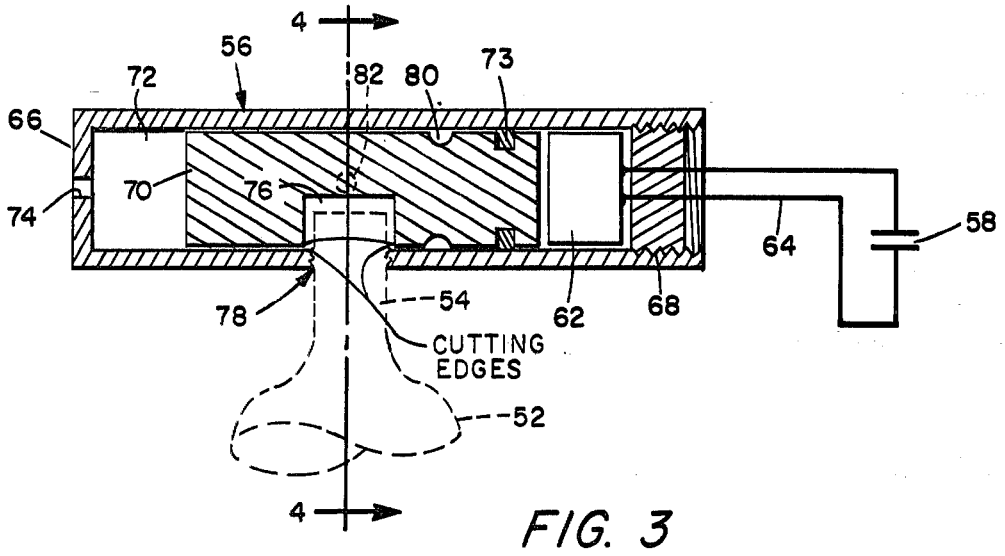
FIG. 3 is an axial sectional view of the cutter assembly of FIG. 2, the bottle of FIG. 2 being shown in phantom, and a squib and battery circuit being shown diagrammatically.
Figure 4:
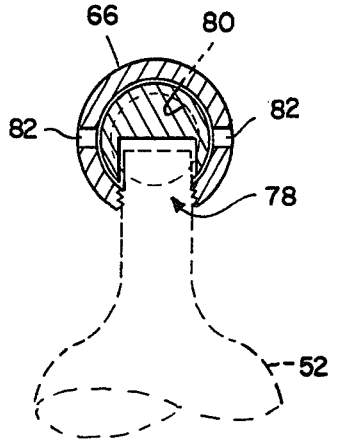
FIG. 4 is a sectional view of the cutter assembly of FIG. 2 taken along the lines 4—4 of FIG. 3.

In accordance with the invention, the compressed fluid within the bottle 52 is released by a cutter assembly 56 which severs the end of the neck 54 from the rest of the bottle 52 to provide a non-constricting passage to the flow of carbon dioxide gas from the bottle 52 to the interior of the surface unit 34. The cutter assembly 56, as will be described in greater detail with reference to FIG. 3, is activated by electric power provided by a well known salt-water battery 58. The battery 58 in turn, is activated by the entry of water of the ocean 24 through a port 60 in the housing 46 upon entry of the sonobuoy 20 into the ocean 24.

Figure 5:
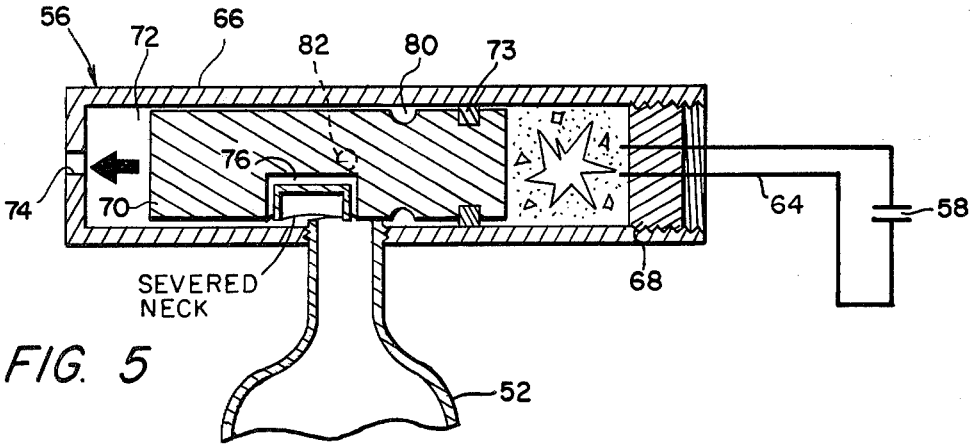
FIG. 5 is an axial sectional view of the cutter assembly of FIG. 2 wherein the piston thereof has been partially displaced immediately following a detonation of the squib.
Figure 6:
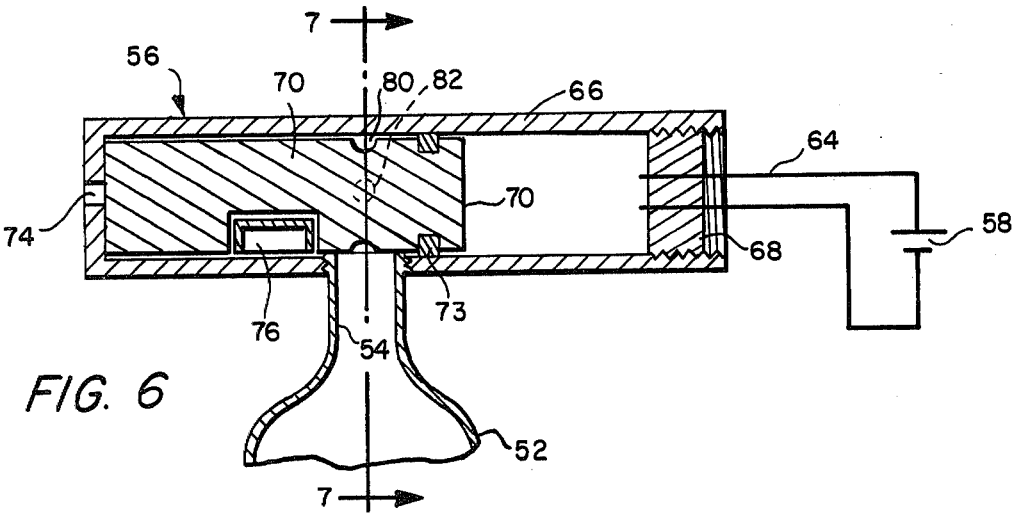
FIG. 6 is a view of the cutter assembly, similar to that of FIG. 5, showing a completion of the displacement of the piston subsequent to the explosion of the squib.

Referring also to FIGS. 3–8, the cutter assembly 56 is seen to comprise a squib assembly 62 including a firing circuit (not shown) which is coupled via electrical leads 64 to the battery 58. The squib assembly 62 is secured within a housing 66 of the cutter assembly 56 by a plug 68 which is threadedly secured to the back end of the housing 66. The leads 64 are seen passing through the plug 68 to connect between the squib assembly 62 and the battery 58. A piston 70 is slidably mounted within a cavity 72 of the housing 66 and is displaced from its initial position, as seen in FIG. 3, to its final position, as seen in FIG. 6, by an explosion of an explosive charge within the squib assembly 62. An O-ring 73 is secured about the periphery of the piston 70 for containing the blast of the explosive charge within the region behind the piston 70. An aperture 74 in the front end of the housing 66 permits the escape of entrapped air within a void in front of the piston 70 as it advances toward the front end of the housing 66.

A feature of the invention is the provision of a recess 76 within the piston 70, the recess 76 being configured to mate with the end of the neck 54. In the initial position of the piston 70, as shown in FIG. 3, the recess 76 is in alignment with an aperture 78 in the side of the housing 66 through which the neck 54 is inserted into the recess 76, and is threadedly secured to the housing 66. Cutting edges are provided along the rim of the recess 76 and along the periphery of the aperture 78 which shear the neck 54 upon a displacement of the recess 76 relative to the aperture 78. The shearing action and severing of the end of the neck 54 are seen in FIG. 5 wherein the piston 70 is seen being propelled to the left by the detonation of the charge in the squib assembly 62.

Figure 7:
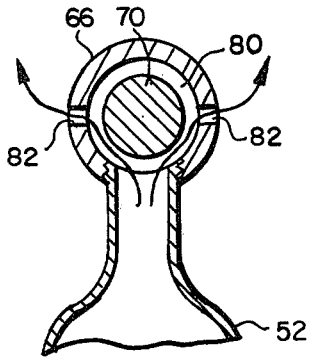
FIG. 7 is a sectional view of the cutter assembly of FIG. 2 taken along the lines 7—7 of FIG. 6.
Figure 8:
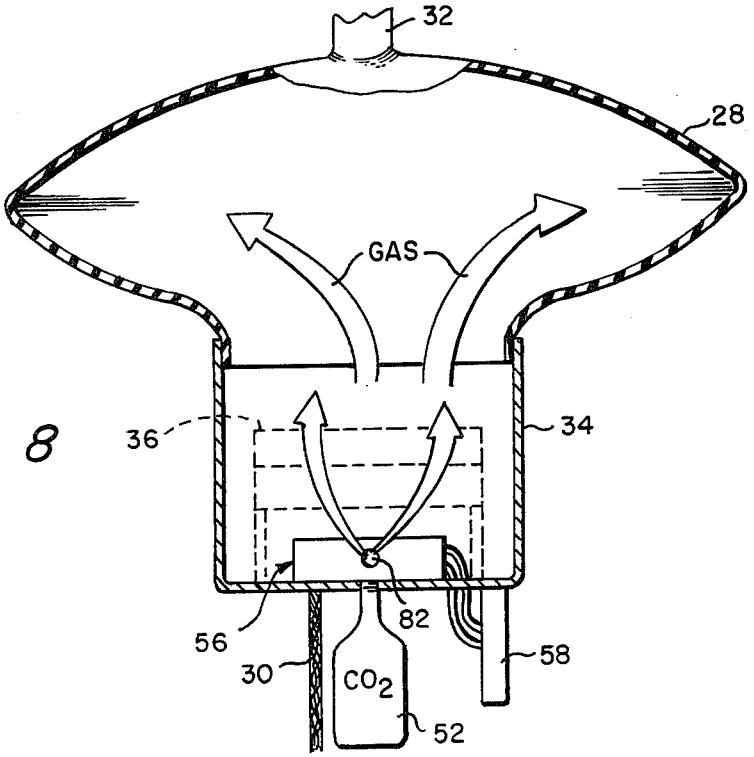
FIG. 8 shows a view, partially stylized and in section, of the surface unit of the sonobuoy of FIG. 2 as the float is expanded in response to the gas escaping from the bottle via ports in the cutter assembly.

A valve is formed by means of a groove 80, disposed circumferentially within the side wall of the piston 70, and a pair of exhaust ports 82 disposed within the side wall of the housing 66 in a transverse plane containing the axis of the aperture 78. After the translation of the piston 70 to the left end of the housing 66, as seen in FIGS. 6–7, the groove 80 provides a passage for gas flowing from the bottle to the ports 82. In FIG. 8, the gas is seen to flow from the ports 82 to fill the surface unit 34 and inflate the float 28. Thereupon, as noted hereinabove, the pressure of the inflating float 28 deforms the plate 44 of FIG. 2 to release the float 28 and the surface unit 34 from the housing 66 of the sonobuoy 20, this being followed by the suspension of the sonar 42 in the lower portion of the sonobuoy 20 at a predetermined depth by the cable 30 which attaches the sonar 42 to the surface unit 34.

It is understood that the above described embodiment of the invention is illustrative only and that modifications thereof may occur to those skilled in the art. Accordingly, it is desired that this invention is not to be limited to the embodiment disclosed herein, but is to be limited only as defined by the appended claims.

What is claimed is:

1. A flotation system for a buoy comprising:

a float;

a container enclosing a fluid for inflating said float;

a chamber connecting said container with said float;

a cutter located within said chamber, said cutter having a cutting edge, a portion of said container extending into said chamber adjacent said cutting edge;

means including an explosive charge for activating said cutter, upon deployment of said buoy, to sever said portion from said container for releasing the fluid enclosed in said container; and said cutter comprises a piston for driving said cutting edge, said piston slidably mating with a wall of said chamber, said portion of said container extending past the surface of said wall via an aperture in said wall, said piston being adapted to admit a flow of said fluid from said container to said float subsequent to severing said container portion in response to activation of said cutter by said explosive charge.

2. A system according to claim 1 wherein said piston has a passage posteriorly to said cutting edge for admitting said flow of said fluid from said container to said float subsequent to said activation of said cutter by a displacement of said cutting edge past said container portion.

3. A system according to claim 1 wherein said activating means includes squib means as said explosive charge located posteriorly to said piston, and responsive to the presence of water around said buoy, for explosively urging said piston and said cutting edge past said container.

4. A system according to claim 1 wherein said aperture has a cutting edge which provides a shearing action with the cutting edge of said cutter against said portion of said container during a sliding of said piston.

5. A system according to claim 1 wherein said piston includes a recess for mating with the portion of said container extending past the surface of said wall of said chamber.

6. The system according to claim 5 wherein the cutting edge of said cutter is located along the rim of said recess in said piston.

7. A system according to claim 2 wherein said passage is formed of a groove disposed circumferentially around said piston, and wherein said wall of said chamber includes an output port which communicates with said aperture via said groove upon a completion of said displacement of said cutting edge of said cutter.

* * * * *

UNITED STATES PATENT OFFICE

CERTIFICATE OF CORRECTION

Patent No. 4,309,786 Dated January 12, 1982

Inventor(s) David A. Sharp and David J. Salisbury

It is certified that error appears in the above-identified patent and that said Letters Patent are hereby corrected as shown below:

Column 2, line 30, delete "development" and replace with --deployment--.

Signed and Sealed this

Twentieth Day of April 1982

[SEAL]

Attest:

GERALD J. MOSSINGHOFF

Attesting Officer

Commissioner of Patents and Trademarks